United States Patent [19]

Dupressoir et al.

[11] Patent Number: 4,502,053

[45] Date of Patent: Feb. 26, 1985

[54] CIRCULARLY POLARIZED ELECTROMAGNETIC-WAVE RADIATOR

[75] Inventors: Albert Dupressoir; Francois Salvat, both of Paris, France

[73] Assignee: Thomson-CSF, Paris, France

[21] Appl. No.: 376,718

[22] Filed: May 10, 1982

[30] Foreign Application Priority Data

May 15, 1981 [FR] France ..... 81 09760

[51] Int. Cl.[3] ..... H01Q 1/36; H01Q 1/38

[52] U.S. Cl. ..... 343/727; 343/795; 343/772; 343/834

[58] Field of Search ..... 343/725, 727, 729, 730, 343/786, 772, 775, 795, 778, 783, 807, 818, 779, 834

[56] References Cited

U.S. PATENT DOCUMENTS

| | | | |
|---|---|---|---|
| 2,946,055 | 7/1960 | Faflick | 343/727 |
| 3,623,112 | 11/1971 | Rupp | 343/727 |
| 4,063,248 | 12/1977 | Debski et al. | 343/727 |
| 4,298,878 | 11/1981 | Dupressoir et al. | 343/772 |
| 4,309,709 | 1/1982 | Hill | 343/727 |

FOREIGN PATENT DOCUMENTS

| | | |
|---|---|---|
| 2452804 | 10/1980 | France . |
| 787756 | 12/1957 | United Kingdom . |

*Primary Examiner*—Eli Lieberman
*Assistant Examiner*—Michael C. Wimer
*Attorney, Agent, or Firm*—Karl F. Ross; Herbert Dubno

[57] ABSTRACT

A circularly polarized electromagnetic-wave radiator, formed from a rectangular section waveguide and a dipole, is energized directly by the guide and placed in the extension of its largest faces. An associated reflector element enables coincidence of the two respective phase centers of the guide and the dipole.

6 Claims, 3 Drawing Figures

PRIOR ART

CIRCULARLY POLARIZED ELECTROMAGNETIC-WAVE RADIATOR

FIELD OF THE INVENTION

Our present invention relates to a radiator for circularly polarized electromagnetic waves. It operates preferably in the microwave range and can be used as a primary source, illuminating an optical focusing system, or as a radiating element in a network antenna.

BACKGROUND OF THE INVENTION

The construction of a circularly-polarized-wave radiator from rectilinearly polarized sources may be achieved by one of two combinations. One can use either two identical sources—two dipoles or two slits—disposed perpendicularly to each other, or two superimposed complementary sources such as a dipole and a slit for example.

According to one structure of the prior art, shown in FIG. 1 of the accompanying drawing, such a wave radiator is formed by two complementary sources nested one in the other. The two sources are a dipole 1 photo-etched on a dielectric plate 2, placed in the median longitudinal plane II of a waveguide 3 of rectangular cross-section, and two waveguides 4 and 5 formed from respective halves into which waveguide 3 is divided by plate 2. These two guides 4 and 5 are energized by feed probes 6, connected to a supply line 7, whereas dipole 1 is connected to its supply line 8 through a balun 9.

The construction of such a wave radiator is relatively complicated, since it requires among other things the provision of two power supplies, one for the dipole and the other for the waveguides. Furthermore, since the two waveguides are reduced in height, they do not behave well under high power.

OBJECT OF THE INVENTION

The aim of our present invention is to provide a radiator of circularly polarized electromagnetic waves free from the above-mentioned drawbacks of the prior art.

SUMMARY OF THE INVENTION

Such a radiator is formed, in accordance with our invention, from a waveguide and a dipole which is energized directly by the waveguide and is so shaped that the feed lines of its two oppositely pointing stems are extensions of the two major faces of the guide and are formed by metal tongues which are symmetrical with respect to the longitudinal axis of symmetry of the guide while the two stems are metal strips formed as integral transverse extensions of these tongues, symmetrical with respect to the guide axis, lying in the planes of the major guide faces. The strips, tongues and guide faces could all be constituted by metallic coatings on a dielectric support. A reflector element transverse to the axis frames the radiating aperture of the guide at its junction with the feed lines of the dipole.

BRIEF DESCRIPTION OF THE DRAWING

The above and other features of our invention will now be described in detail with reference to the accompanying drawing in which.

Specific Description

To form a radiator of electromagnetic waves with circular polarization from two sources emitting rectilinearly polarized waves, these sources must generate two components equal in amplitude, orthogonal in space and in phase quadrature with each other. The circular polarization of the resulting wave will be said to be right-handed or left-handed depending on which of the two components is leading.

When the two sources emitting rectilinearly polarized waves are not of the same nature but are mutually complementary, as is the case with our present invention, it has been demonstrated according to Babinet's principle that the diagrams of these two sources are theoretically the same in all planes as long as their magnetic fields E correspond to each other. At a great distance these two complementary sources emit waves whose polarizations are mutually orthogonal and equal in amplitude in all directions in space and are in phase quadrature with each other.

This phase quadrature is achieved when, with suitable dimensioning of the feed lines whose length generally equals a fraction of a wavelength at the midfrequency of an operating band supplied to the guide, the two phase centers of the two complementary sources are merged.

Figure 1:
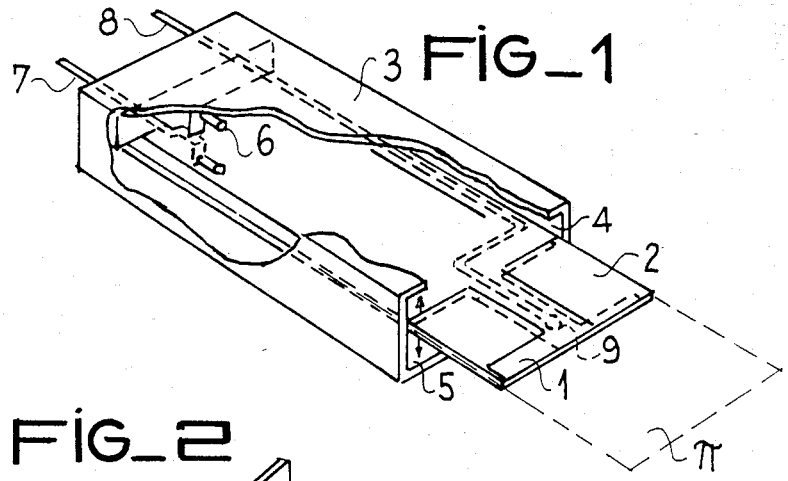
FIG. 1, already described, is a perspective view of a prior-art structure.
Figure 2:
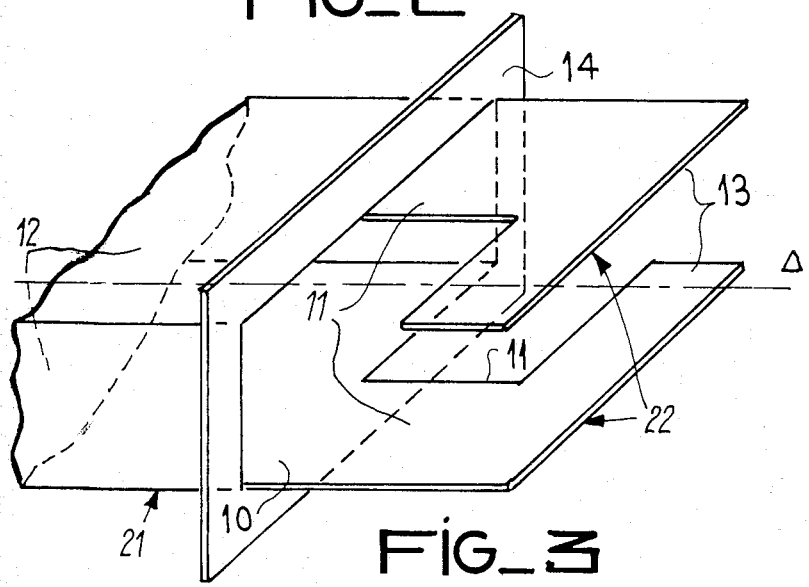
FIGS. 2 and 3 are perspective views of two representative embodiments of our improved wave radiator.

FIG. 2 shows one embodiment of a radiator of circularly polarized waves formed from two complementary sources, namely a waveguide 21 and a dipole 22, each emitting a rectilinearly polarized wave.

Beyond the radiating aperture 10 of waveguide 21, feed lines 11 of dipole 22, each formed as a flat metal tongue, are designed as coplanar extensions of the two major sides 12 of the guide, symmetrically offset on opposite sides of its longitudinal axis Δ. Oppositely pointing stems 13 of the dipole are formed at flat metal strips perpendicular to the feed lines 11 integral therewith, also situated in the planes of the major sides of the waveguide. The respective widths of lines 11 are chosen to contribute to the impedance matching between the dipole and the waveguide.

Dipole 22 is energized directly by waveguide 21 and the coincidence of the two phase centers of these sources is made possible by the presence of a metal flange 14 framing the periphery of the radiating aperture 10 in a plane perpendicular to the four sides of this guide. In fact, the phase center of waveguide 21 is in the plane of its radiating aperture 10 and the phase center of dipole 22 provided with the reflector element formed by the metal flange 14 is in the plane of the flange coinciding with the plane of the aperture 10.

Figure 3:
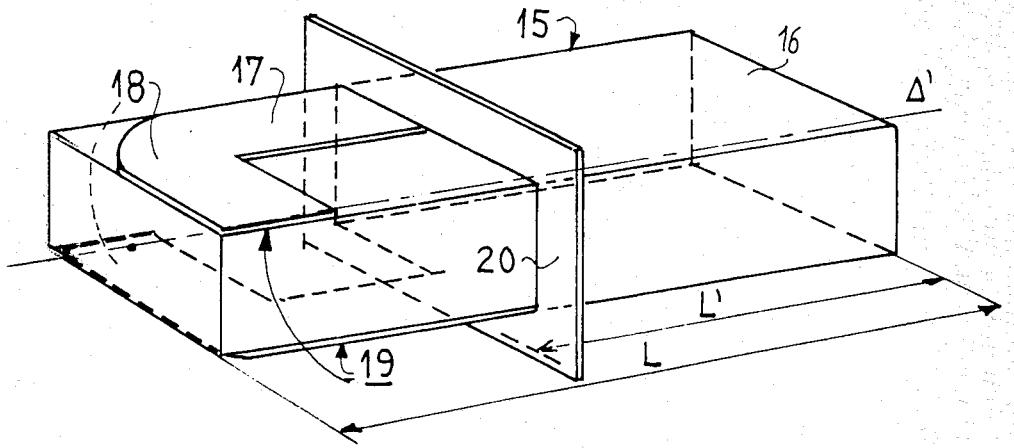

According to another embodiment of our invention, shown in FIG. 3, a waveguide 15 is formed by a parallelepipedic or rectangularly prismatic block 16 of dielectric material, metal-coated on the four faces thereof parallel to the longitudinal axis of symmetry Δ', over a length L' less than the length L of the dielectric block itself. Feed lines 17 of stems 18 of a dipole 19 are again metal tongues, deposited by photo-etching on the dielectric block 16 in extensions of the two major faces of the waveguide. The stems 18 of the dipole are constituted by transverse extensions of the tongues 17 forming the feed lines. The dimensions of waveguide 15 are such that the magnitude of the polarization of the wave emitted by this guide is equal to that of the polarization of the wave emitted by dipole 19. Contrary to FIG. 2, where the transition between the feed lines and the stems of the dipole is abrupt, in FIG. 3 the transtion takes place very gradually. In both instances, however, the stems of the dipole have a length coextensive with the width of the major waveguide sides.

The reflector element 20, associated with the dipole, is formed by a metal frame perpendicular to the sides of the waveguide and bonded to the metal coating thereof.

In both embodiments, the stems of the dipole may have a length equal to a quarter wavelength, half a wavelength or an entire wavelength at the central frequency of the operating band of this dipole.

According to a practical mode of realization of a circularly-polarized-wave radiator in accordance with our invention, operating in a band of wavelengths close to 10 cm, the rectangular-section waveguide has internal dimensions of 72.15 mm×28.4 mm; the radiating frame is formed by metal flanges 22 mm wide rising from the two major faces of the guide and 10 mm wide for those rising from the other, minor two faces. The feed lines and the stems of the dipole are made from brass, 2 mm thick, their respective lengths being close to a quarter wavelength and a half wavelength at the central frequency of the operating band of the dipole. In a more general case, the cross-section of the waveguide forming the radiator need not be rectangular, as described above, but could be square or circular, provided that the propagation mode in the guide is the fundamental mode.

The described radiator of circularly polarized electromagnetic waves can be used alone, as a primary source for a reflector, or as an element of a network antenna—with or without phase shifting—in association with other sources.

We claim:

1. A radiator of circularly polarized electromagnetic waves, comprising:

a first source of linearly polarized electromagnetic waves constituted by a waveguide having a radiation aperture;

a second source of linearly polarized electromagnetic waves with a direction of polarization perpendicular to that of said first source, said second source being constituted by a dipole with oppositely pointing metallic stems joined to said waveguide at opposite points of the periphery of said aperture by way of respective feed lines of a length corresponding to a fraction of a wavelength at a midfrequency of an operating band supplied to said waveguide, said stems lying in planes which symmetrically parallel the waveguide axis and are perpendicular to the direction of polarization of the waves radiated by said waveguide; and a flat metallic reflector surrounding said waveguide around the periphery of said aperture in conductive contact with said waveguide and with said feed lines for making the phase center of said dipole coincide with that of said waveguide at said aperture, said feed lines being dimensioned to match the impedances of said dipole and said waveguide and to establish phase quadrature between the waves respectively emitted thereby.

2. A radiator as defined in claim 1 wherein said waveguide has a rectangular cross-section with major and minor sides, said feed lines being coplanar extensions of said major sides, said stems being integral with said feed lines and lying in the planes of said major sides.

3. A radiator as defined in claim 2 wherein said feed lines are tongues extending from said major sides at mutually offset locations on opposite sides of said axis, said stems being strips of a length coextensive with the width of said major sides.

4. A radiator as defined in claim 3 wherein said reflector is a rectangular frame consisting of flanges rising perpendicularly from said major and minor sides in the plane of said aperture.

5. A radiator as defined in claim 4 wherein said major and minor sides, said tongues and said strips are metallic coatings on outer surfaces of a rectangularly prismatic block of dielectric material traversing said frame.

6. A radiator as defined in claim 2 wherein said feed lines and said stems have lengths respectively approximating a quarter wavelength and a half wavelength at said midfrequency.

* * * * *